US007117979B2

(12) United States Patent
Angst et al.

(10) Patent No.: US 7,117,979 B2
(45) Date of Patent: Oct. 10, 2006

(54) METHOD FOR PREVENTING AN INADMISSIBLY HIGH SPEED OF THE LOAD RECEIVING MEANS OF AN ELEVATOR

(75) Inventors: Philipp Angst, Zug (CH); Romeo Deplazes, Oberrüti (CH)

(73) Assignee: Inventio AG, Hergiswil (CH)

( * ) Notice: Subject to any disclaimer, the term of this patent is extended or adjusted under 35 U.S.C. 154(b) by 419 days.

(21) Appl. No.: 10/481,615

(22) PCT Filed: Jun. 27, 2002

(86) PCT No.: PCT/CH02/00350

§ 371 (c)(1),
(2), (4) Date: Dec. 19, 2003

(87) PCT Pub. No.: WO03/004397

PCT Pub. Date: Jan. 16, 2003

(65) Prior Publication Data

US 2004/0173413 A1 Sep. 9, 2004

(30) Foreign Application Priority Data

Jul. 4, 2001 (EP) ..... 01810654

(51) Int. Cl.
*B66B 5/16* (2006.01)

(52) U.S. Cl. ..... 187/351; 187/286; 187/288; 187/305

(58) Field of Classification Search ..... 187/250, 187/254, 286–287, 275, 277, 305, 314, 375, 187/359, 351; 188/71.1, 71.5, 72.1, 106 P, 188/362, 370; 318/371
See application file for complete search history.

(56) References Cited

U.S. PATENT DOCUMENTS

| | | | | |
|---|---|---|---|---|
| 3,601,235 | A * | 8/1971 | Huf | 477/184 |
| 4,378,059 | A | 3/1983 | Hatakeyama et al. | |
| 4,638,888 | A * | 1/1987 | Coy | 187/270 |
| 4,800,990 | A | 1/1989 | Blain | |
| 5,226,508 | A * | 7/1993 | Ericson et al. | 187/254 |
| 5,323,878 | A * | 6/1994 | Nakamura et al. | 187/264 |
| 5,648,644 | A * | 7/1997 | Nagel | 187/288 |
| 6,170,614 | B1 | 1/2001 | Herkel et al. | |
| 6,371,248 | B1 * | 4/2002 | Cholinski | 187/254 |
| 6,557,670 | B1 * | 5/2003 | Wang | 187/290 |
| 6,957,721 | B1 * | 10/2005 | Moser | 187/285 |

FOREIGN PATENT DOCUMENTS

GB 2 153 465 8/1985

* cited by examiner

*Primary Examiner*—Jonathan Salata
(74) *Attorney, Agent, or Firm*—Wolff & Samson PC; Klaus P. Stoffel

(57) ABSTRACT

A method for preventing an inadmissibly high speed of a load receiving unit of an elevator, including the steps of supplying information about an actual position and an actual speed of the load receiving unit in an area of an entire travel way of the load receiving unit to a speed monitoring device by at least one measuring system, continuously comparing the actual speed with a speed limit value by the speed monitoring device, and activating braking measures if the speed of the load receiving unit exceeds a speed limit value. At least three different braking measures are successively triggered by the speed monitoring device.

15 Claims, 5 Drawing Sheets

Fig. 7
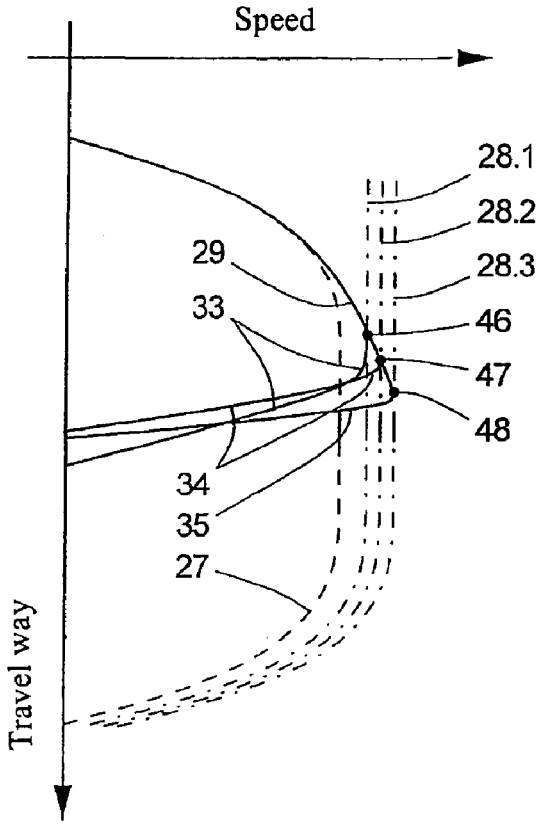
Fig. 8
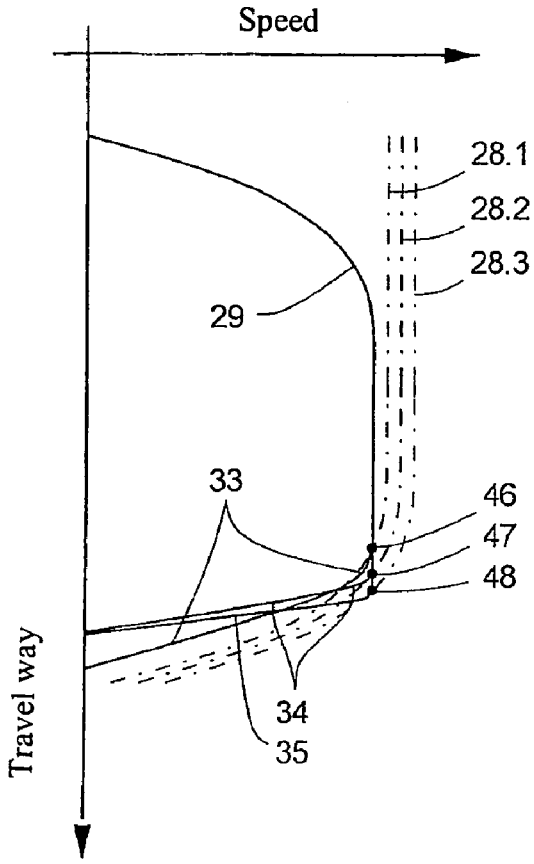
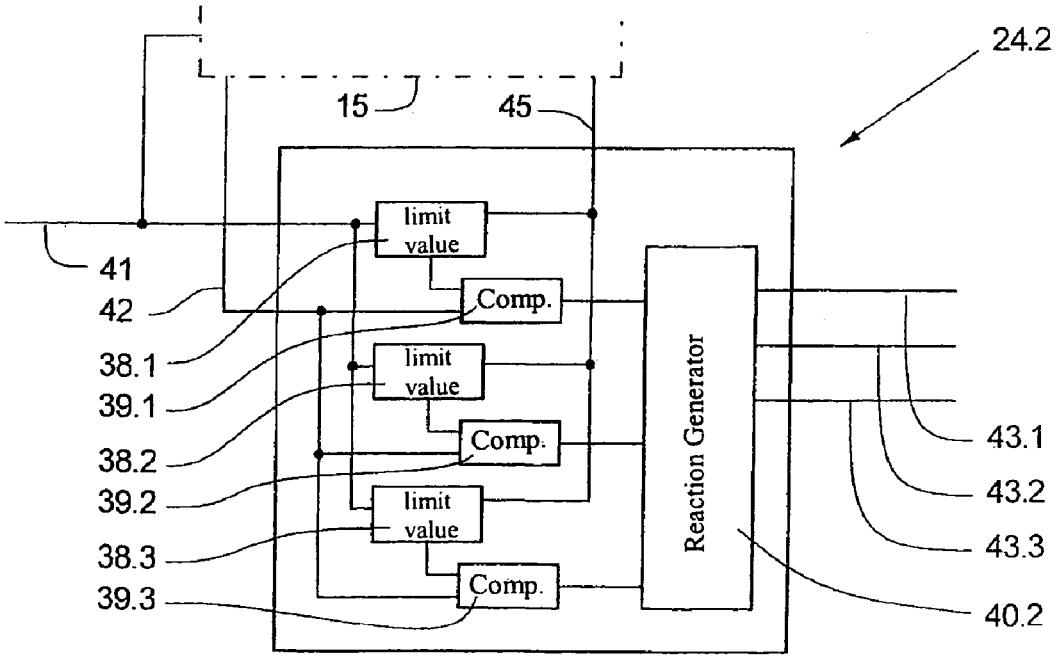
Fig. 9

METHOD FOR PREVENTING AN INADMISSIBLY HIGH SPEED OF THE LOAD RECEIVING MEANS OF AN ELEVATOR

This application is a U.S. National stage of PCT/CH02/00350, filed Jun. 27, 2002 and claims priority, from European Application No. 01810654.2.

BACKGROUND OF THE INVENTION

The invention relates to a method for preventing an inadmissibly high speed of the load receiving means of an elevator.

Regulations for the construction and operation of elevators require means and procedures to be used, which during any phase of the elevator operation prevent an inadmissibly high speed of the load receiving means with a maximum degree of reliability.

Conventional elevators are equipped with a safety catch that, when the speed of the load receiving means reaches a defined speed limit, is activated by a speed limiting device and that brakes and stops the load receiving means with the highest admissible delay.

U.S. Pat. No. 6,170,614 B1 discloses an electronic speed limiting system that continuously receives information about the actual position of the load receiving means from a position measuring device and that calculates the actual speed from this. A microprocessor then continuously compares this actual speed with fixed-programmed limiting values applying for the entire travel way, which are assigned to certain operating modes of the elevator, for example, to an upward or downward movement. When the actual speed of the load receiving means exceeds the current active limit value, the electronic speed limiting system activates an electro-magnetically operated safety catch that stops the load receiving means.

The described electronic speed limiting system has considerable disadvantages. Every time it is detected that the limit value has been exceeded, the safety catch is activated and the operation of the elevator is thus stopped, with in most cases, passengers not being able to leave the elevator before a service engineer has returned the elevator to operation or returned the load receiving means to an access zone. Any excess speed will thus cause braking of the load receiving means with highest admissible delay values, which is extremely unpleasant for passengers and can cause anxiety and may even injure infirm persons.

SUMMARY OF THE INVENTION

The present invention therefore has the task to disclose a method for preventing an inadmissibly high speed of the load receiving means of an elevator, which ensures that in the case of a detected excess speed it can be avoided that the operation of the elevator is stopped, that passengers are, where possible, never trapped in the elevator and will only in case of an extreme emergency be exposed to the effects of a considerable delay of the safety catch.

Pursuant to this task, an aspect of the present invention resides in the method for preventing an inadmissibly high speed of a load receiving means of an elevator, which method includes supplying information about an actual position and an actual speed of the load receiving means, in an entire area of an entire travel way of the load receiving means, to a speed monitoring device by at least one measuring system. The method further includes continuously comparing the actual speed with a speed limit value in the speed monitoring device, and activating braking measures if the speed of the load receiving means exceeds a speed limit value. The speed monitoring device successively triggers at least three different braking measures.

The advantages offered by the method of the invention are mainly that a higher availability is attained for the elevator system and that, as a result of avoiding safety braking as far as possible, elevator users are not unnecessarily frightened and blocked in the load receiving means and that, on the other hand no costs for stress relieving the elevator have to be paid after a safety braking operation.

In a preferred embodiment of the invention, the speed monitoring device triggers a certain braking measure if one of the speed limit values assigned to such a braking measure is exceeded. This method ensures that a save and simple form of a multistage speed monitoring device can be implemented.

According to a cost-effective embodiment of the invention, a respective braking measure is always triggered if a preceding braking measure has not produced a defined speed reduction within a defined period.

A further development of the invention, particularly advantageous from a technical safety point of view, is achieved by a further braking measure being triggered if one of the speed limit values assigned to this braking measure is exceeded or if a preceding braking measure has not produced a defined speed reduction within a defined period. Both criteria are monitored simultaneously and a further braking measure is activated if one of the two criteria has been fulfilled.

For elevators equipped with a drive unit containing a speed control device, the method of the invention offers a particular advantageous embodiment as one of the braking measures consists of the speed-monitoring device attempting to influence the speed control device in such a way that it reduces the drive speed of the load receiving means. As a result, the activation of a mechanical friction brake and stopping of the elevator is avoided in many cases.

Particularly simple and useful is an embodiment of the method described above, in which the reduction of the drive speed of the load receiving means is supposed to be achieved by a permanently stored speed setpoint being applied to a setpoint input of the speed control device.

Another braking measure applicable with the method of the invention consists of a friction brake, that is supposed to reduce the speed or stop the load receiving means, acting directly or indirectly on the driving wheel of a cable-pulled elevator containing a drive machine, with the drive machine being switched off before this operation. As a result, the load receiving means is almost certainly slowed down so that the use of a safety catch can, in most cases, be avoided.

Where the method according to the invention is used in a hydraulically operated elevator system, advantageous braking measures consist of the speed monitoring device increasingly restricting the flow of a hydraulic medium via a separate flow valve or activating a friction brake acting on a piston rod of a hydraulic lifter, as a result of which the speed of the load receiving means is reduced or the load receiving means is stopped.

In another useful further development of the method, a braking measure consists of a safety catch being activated by a speed monitoring device, with the safety catch being attached to the load receiving means and, when activated, acting on rails permanently installed along the travel way and thus stopping the load receiving means.

A particularly advantageous embodiment of the method according to the invention is that the speed limit values assigned to the individual braking measures with which the speed monitoring device continuously compares the actual speed, are dependent on the actual position of the load receiving means and include a reduction of the speed required in both end zones of the travel way. These speed limit values can also depend on a particular operating mode (i.e. ramping operation, inspection, error mode, etc.). As a result, the conventional delay control devices in both end zones of the travel way of the load receiving means are no longer required. This also allows the buffers that prevent a hard impact of the load receiving means in conventional elevators to be removed or reduced considerably in size, as the delay of the load receiving means in the end zone of the travel way is safely monitored by the controls.

The speed limit values—assigned to the individual braking measures—with which the speed control device continuously compares the actual speed, are suitably and permanently defined for each position of the load receiving means on its travel way, and possibly depending on the currently activated special operating mode and are electronically stored, i.e. in tables. The permanently stored position-dependant speed limits ensure that the method of the invention has a high operational reliability.

A further advantageous embodiment of the method is achieved by the speed limit values—assigned to the individual braking measures—with which the speed control device continuously compares the actual speed, being continuously calculated in accordance with the current position of the load receiving means by a microprocessor integrated in the speed monitoring device. During this operation, the permanently programmed speed limit values, depending on the position and the travel progress information supplied by the elevator controls, in particular, speed reduction when stopping at floors, is also taken into consideration. This has the advantage that the speed-monitoring device is also effective in these reduced speed areas.

Another advantageous further development of the invention is that after a braking measure triggered by excessive speed, the elevator is automatically returned to normal operation or starts an evacuation operation if the type of the last breaking measure as well as the result of an automatically implemented functional test of the components relevant for the safety permit this.

A particularly advantageous embodiment of the method according to the invention is that all functions involved in this method are carried out under the application of fail-safe concepts. Such concepts contain, for instance, redundant position and/or speed measuring devices, actuators for activating braking equipment in the fail-safe design, data storage methods during data transmission, redundant data processing by several, possibly different processors with comparison of the result, etc. In case of any occurring differences, suitable safety measures are triggered. By using such a fail-safe concept as part of the method of the invention, no complicated mechanical speed limiting systems or additional delay control switches are required in both areas of the travel way ends of the load receiving means.

BRIEF DESCRIPTION OF THE DRAWINGS

Below, the invention is explained in detail, using examples referring to the enclosed figures, in which:

FIGS. 7, 8 show the process with several different speed limit value graphs FIG. 9 shows a diagrammatic representation of the speed-monitoring device for application with several speed limit value graphs

DETAILED DESCRIPTION OF THE INVENTION

Figure 1A:
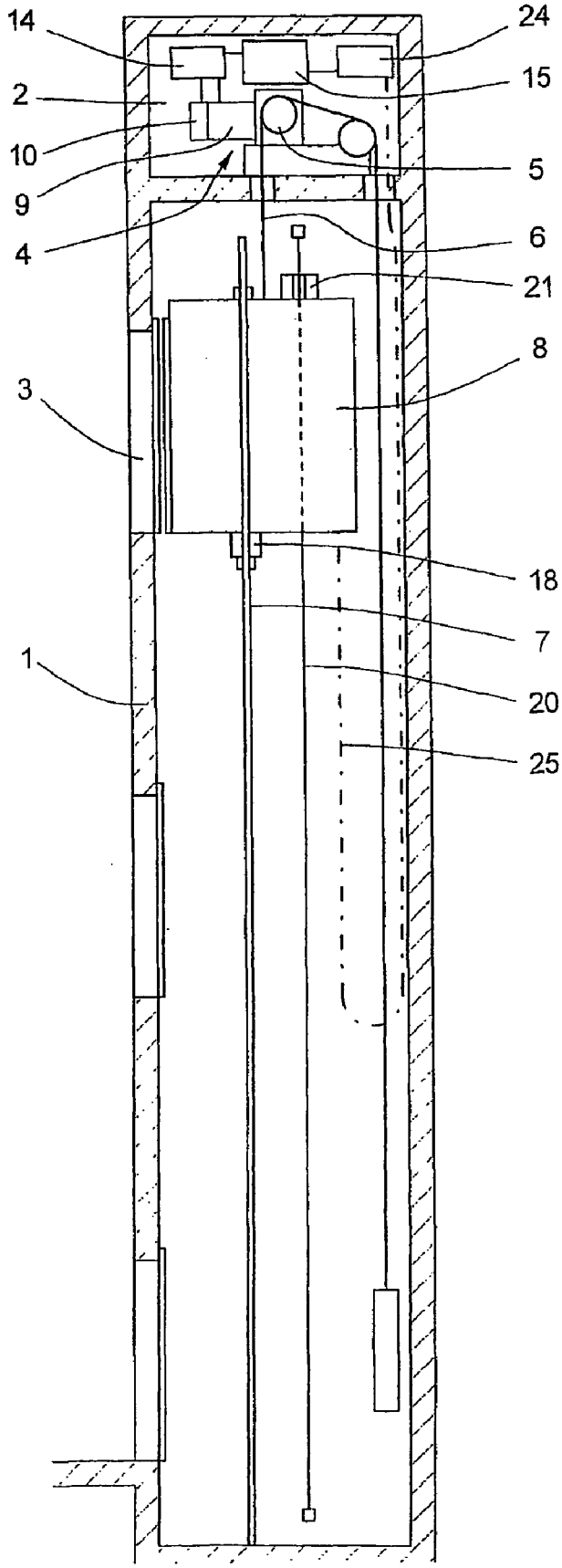
FIG. 1A is a diagrammatic view of an elevator system including a cable drive, containing the elevator components important for illustrating the invention

FIG. 1A shows a diagrammatic view of an elevator system including a cable drive. The figure shows an elevator shaft 1 with a machine room 2 and floor accesses 3. The machine room 2 contains a drive unit 4 that carries and drives an elevator car (load receiving means) 8 guided along guide rails 7 via a driving wheel 5 and pulling cables 6. The drive unit 4 contains a drive motor 9 with an electromechanical drive brake 10. The direction of rotation, speed and drive moment of the drive motor 9 is controlled by a speed control device 14, with the speed control device 14 receiving control commands from an elevator control 15. On the elevator car 8, two safety catches 18 that can, for instance be electromagnetically activated, are installed, with the aid of which the elevator car 8 can be braked and stopped in emergencies. Reference numeral 20 shows a scale covering the entire travel way of the elevator car 8, that contains several binary encoded parallel code tracks. These code tracks are scanned by a position detection device 21 fixed to the elevator car 8, which continuously decodes the actual absolute position of the elevator car 8 from binary signal statuses and which transfers these to the elevator controls 15. By differentiating the position value differences over time, the actual speed of the elevator car 8 is calculated in the elevator controls 15. This also serves as the actual value feedback for speed control device 14 of the drive motor 9. The speed monitoring device 24 has the task of detecting an inadmissibly high speed of the elevator cab 8 and of initiating suitable countermeasures, where applicable. The elevator controls 15, the speed control device 14 and the speed monitoring device 24 are, according to FIG. 1A, connected to each other via signal and/or data lines, which however does not mean that all of these devices cannot be integrated together in a larger unit. The data and signal transmission between these devices on one hand and the position detection device 21 as well as the safety catches 18 on the other hand takes place through an elevator cable 25 unwinding between the elevator car 8 and the shaft wall.

Figure 1B:
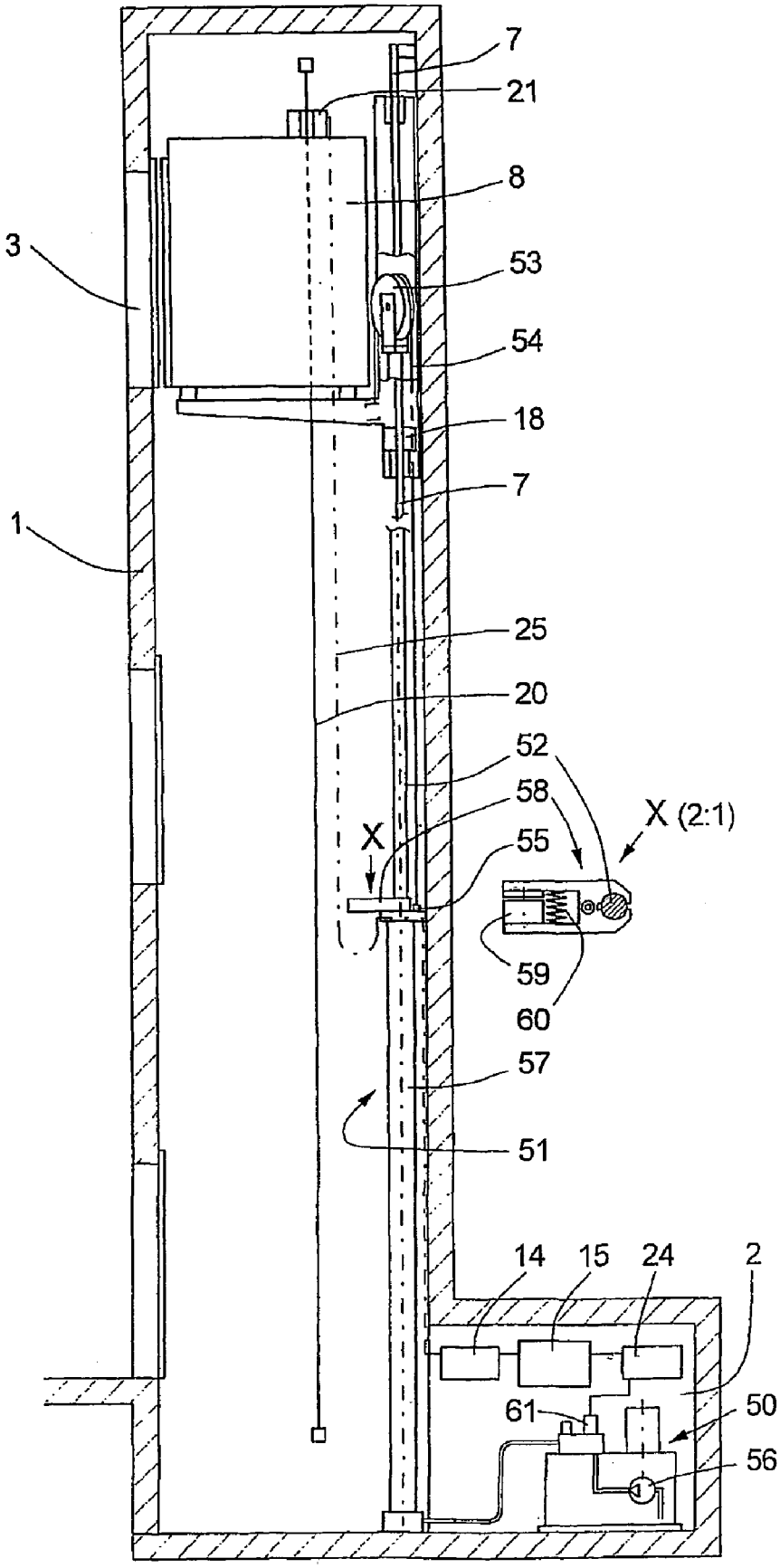
FIG. 1B is a diagrammatic view of an elevator system including a hydraulic drive, containing the elevator components important for illustrating the invention

FIG. 1B represents a diagrammatic view of an elevator system with a hydraulic drive. The figure shows an elevator shaft 1 with a machine room 2 and floor accesses 3. The machine room 2 contains a hydraulic drive unit 50 that drives the piston rod 52 of a hydraulic lifter 51, which contains a deflection roller 53 at its upper end. This deflection roller 53 accommodates pulling cables 54 that are each attached with one of their ends to the fixing point 55 on the lifter 51 and with their other end carry and drive an elevator car (load receiving means) 8 that is guided along guide rails 7. The drive unit 50 is equipped with a speed control device 14 that, for instance, determines the volume and direction of the oil flow via an variable displacement pump 56, said oil flow moving the hydraulic lifter 51 and the speed control unit 14 receiving control commands from the elevator controls 15. On the elevator car 8, two, for example, electro-magnetically activatable safety catches 18 are installed with which in emergencies, i.e. in case of a pulling cable break, the elevator car 8 can be braked and stopped. At the top end of the lifting cylinder 57, an electro-magnetically activatable clasp brake 58 acting on the piston rod 52, is attached. Detail X shows that between this clasp brake 58 and the piston rod 52, a braking force can be generated by the force of a pressure spring 60 when the solenoid 59 is currentless. The braking force is able to brake the elevator car 8 if, for instance, the speed control 14 of the hydraulic drive fails. The solenoid 59 is controlled by the speed monitoring device 24. The hydraulic drive unit 50 contains, apart from other valves, a safety flow valve 61 which can be activated by the speed monitoring device 24 when an excessive speed of the elevator car 8 has been activated, with the safety flow valve continuously reducing the oil flow in such a case so that the elevator car 8 is braked with a defined delay. Reference numeral 20 shows a scale covering the entire travel way of the elevator car 8, that contains several binary encoded parallel code tracks. These code tracks are scanned by a position detection device 21 fixed to the elevator car 8, which continuously decodes the actual absolute position of the elevator car 8 from binary signal statuses and which transfers these to the elevator control 15. By differentiating the position value differences over time, the actual speed of the elevator car 8 is calculated in the elevator controls 15. This also serves as the actual value feedback for the speed control device 14 of the drive unit 50. The speed monitoring device 24 has the task of detecting an inadmissibly high speed of the elevator cab 8 and to initiate suitable countermeasures, where applicable. The elevator controls 15, the speed control device 14 and the speed monitoring device 24 are, according to FIG. 1B, connected to each other via signal and/or data lines, which however does not mean that all of these devices cannot be integrated together in a larger unit. The data and signal transmission between these devices on one hand and the position detection device 21 as well as the safety catches 18 on the other hand takes place through a elevator cable 25 unwinding below the elevator car 8.

Figure 2:
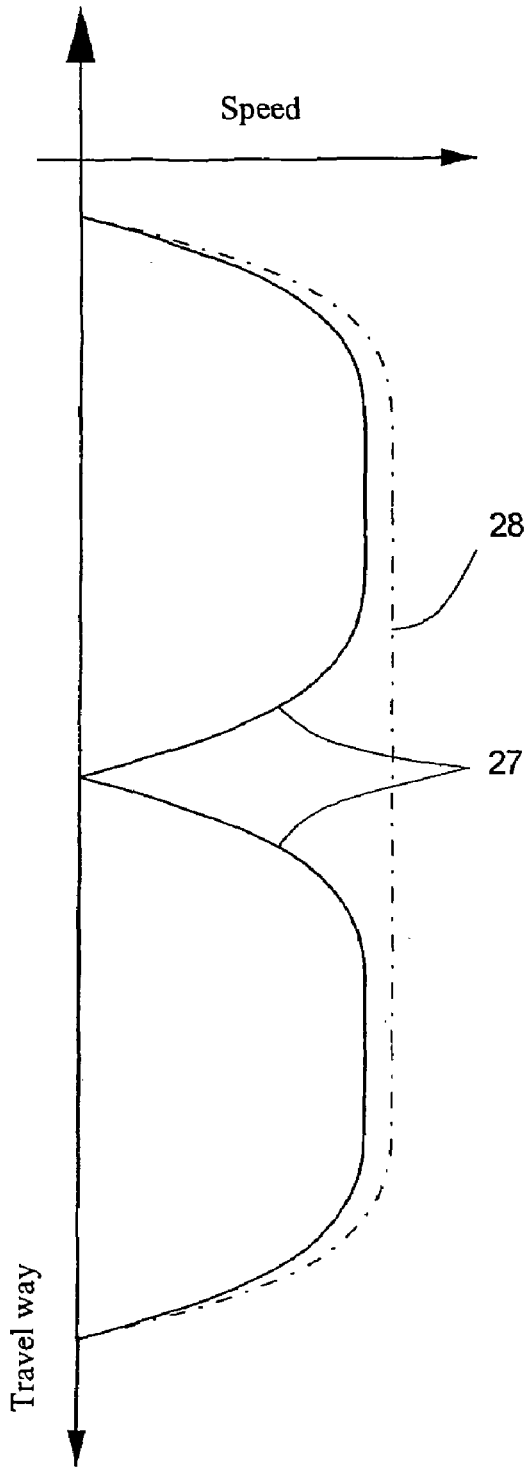
FIGS. 2, 3 show the connections between the speed during normal operation and the speed limit values used by the method of the invention

FIG. 2 contains a diagram, whose vertical axis shows the travel way (position in shaft) and whose horizontal axis shows the speed of the elevator car 8, demonstrating the relationship between the speed during normal operation and the speed limit values monitored by the speed monitoring device 24. The diagram shows a graph for a normal speed operation 27 generated by an elevator travel with an interim stop as well as a speed limit graph 28 that also contains the speed reduction absolutely required in the two travel way end zones. In this model, the values of the speed limit value graph 28 for each position of the elevator car 8 in the elevator shaft 1 are permanently stored in the speed monitoring device 24. Depending on the type of speed monitoring method, a speed limit value graph 28 or several different speed limit value graphs 28 that are assigned to different braking measures, are stored. Depending on any activated special operating modes (i.e. ramping operation, inspection, error mode, etc.) different position-depending speed limit value graphs will be produced.

Figure 3:
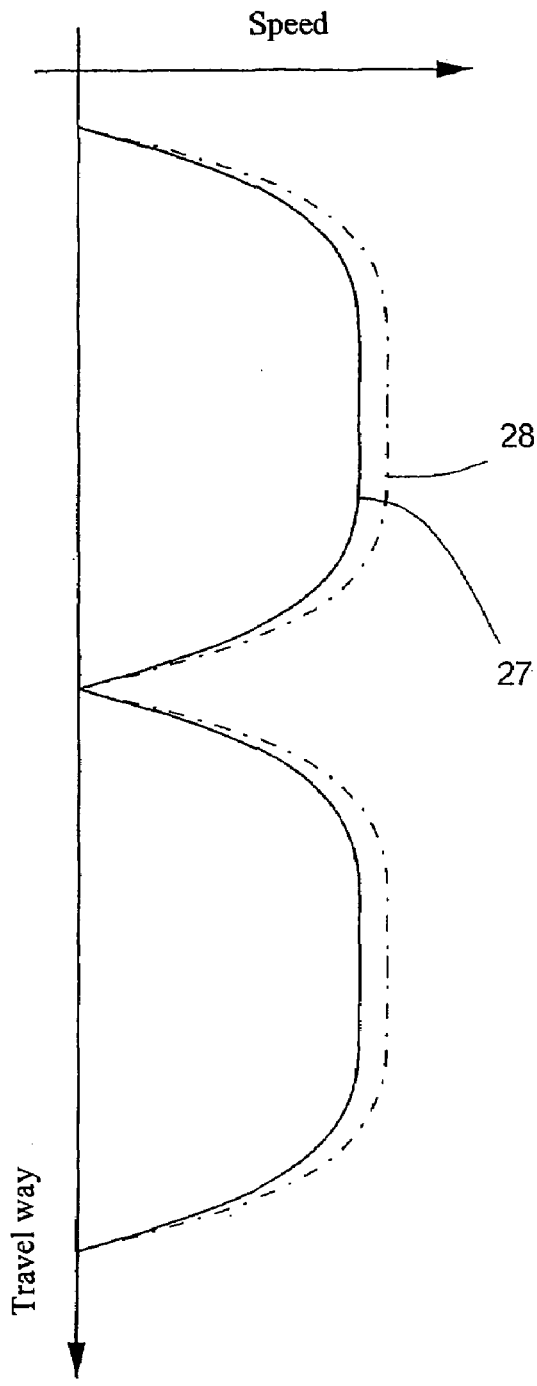

FIG. 3 shows the same diagram as FIG. 2, with the speed limit value graph 28 also including the speed change when stopping at different floors in the area of the travel way end zones. The limit values for these areas are continuously calculated in the speed monitoring device 24 based on the setpoint speed information supplied by the elevator controls 15. Here too, several speed limit value graphs with different permissible deviations can apply and can, depending on any activated particular operating modes (i.e. ramping operation, inspection, error mode, etc.) also show a different course, although this is not shown in this diagram.

Figure 4:
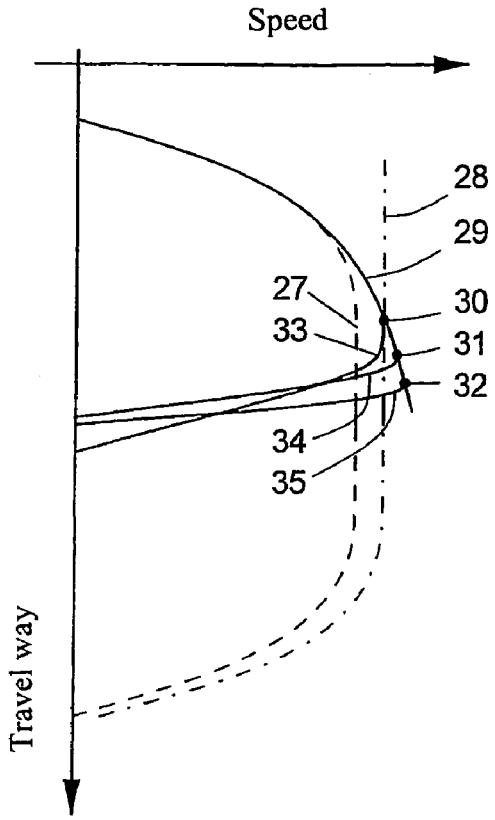
FIGS. 4, 5 show the process with a single speed limit graph
Figure 5:
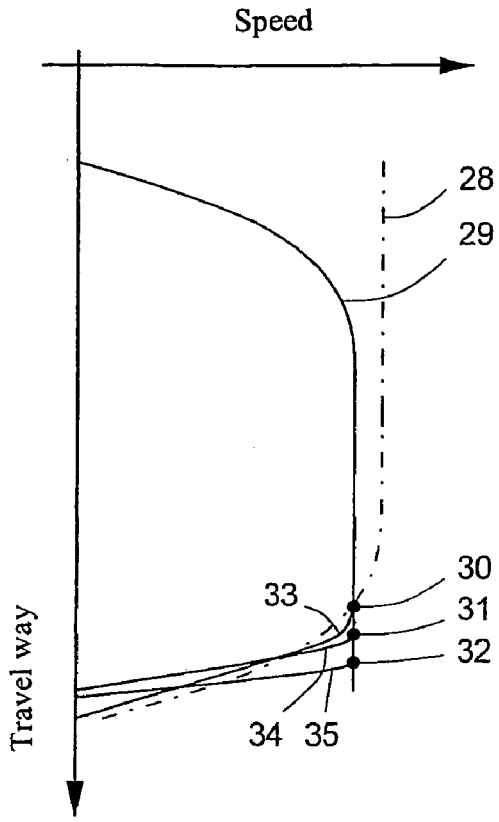

FIGS. 4 and 5 contain a travel way/speed diagram, demonstrating the process of the method according to the invention, containing only a single speed limit graph. In FIG. 4, 27 represents a graph (for comparison) with a normal speed course and 28 represents the speed limit value graph. The course of an entered actual speed graph 29 exceeds the speed limit value graph 28 outside of the travel way end zones at point 30. The speed monitoring device 24.1 (FIG. 6) detects this and activates a braking measure, i.e. in the shown example it attempts to cause the speed control device 14 to reduce the control brake graph 33 with a predefined delay. This first braking measure must not necessarily cause the elevator to stop. If the braking measure of the speed control device 14 has generated a speed below the speed limit value graph 28 and if a system test device integrated in the elevator control 15 does not signal any relevant errors, the elevator can continue its travel as programmed. After a defined short period, measured from the moment of the activation of the first braking measure, the speed monitoring device 24.1 checks whether the speed limit value graph 28 is still being exceeded and activates, where applicable, (at point 31) a second braking measure (the mechanical drive brake 10 on the drive motor 9 in FIG. 1A or the clasp brake 58 acting on the piston rod 52 in FIG. 1B), as a result of which the elevator is braked according to the drive braking graph 34. Where the speed monitoring device 24.1 detects, after a brief further waiting period, that the speed limit value graph 28 is still being exceeded, it triggers (at graph point 32) a last braking measure, according to this embodiment, i.e. it activates the electro-magnetically activatable safety catch 18 that stops the elevator according to safety catch graph 35.

The travel/speed diagram in FIG. 5 shows how, in the method of the invention, containing a single speed limit graph 28, braking measures are triggered, if the actual speed 29 of the elevator exceeds the falling speed limit value graph 28 in a travel end zone or floor stop zone as, for instance, the required reduction of the actual speed does not occur. After the first braking measure was triggered in point 30 by the speed monitoring device 24.1, the same processes, as described above in connection with FIG. 4, apply.

Figure 6:
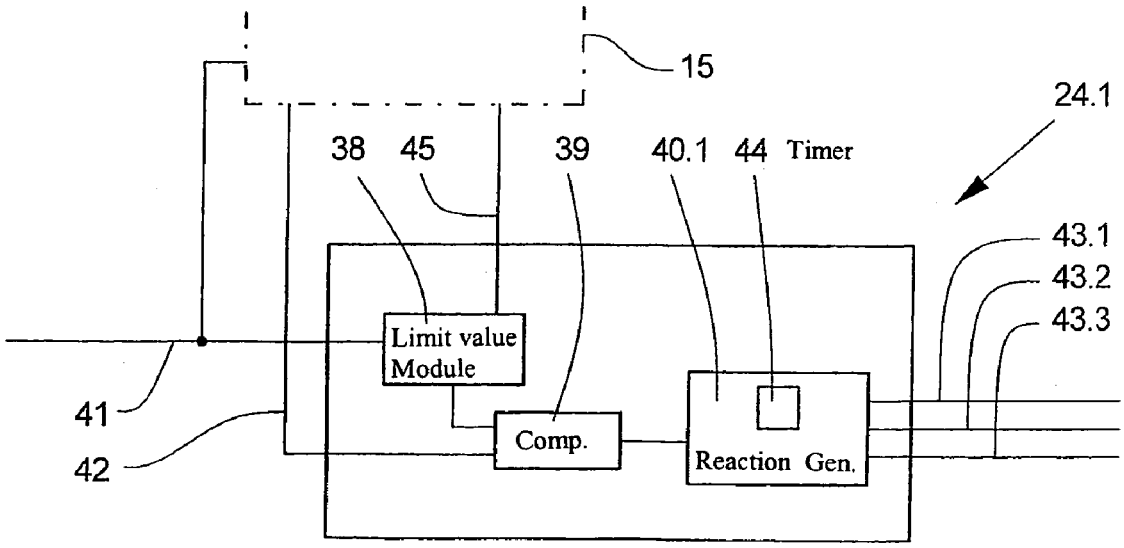
FIG. 6 shows a diagrammatic representation of the speed-monitoring device for the application of a single speed limit value graph

FIG. 6 shows a diagrammatic view of an electronic speed monitoring device 24.1 according to the invention as used for the process with a single speed limit value graph 28. It mainly consists of a limit value module 38, a comparator 39 and a reaction generator 40.1 with a timer 44. The speed monitoring device 24.1, on one hand, continuously receives the information about the actual position of the elevator car 8 in the elevator shaft generated by the position detection device 21. On the other hand, it also obtains information about the current actual speed of the elevator via the actual speed input 42. Based on a table stored in the limit value module 38, the speed limit values assigned to each shaft position are constantly read-out and compared in comparator 39 with the current actual speed. As soon and as long as the comparator 39 detects that the current actual speed exceeds the position-dependent defined current speed limit value, it sends a respective excess speed signal to the reaction generator 40.1. The generator activates the braking measure immediately via one of his braking signal outputs 43.1, 43.2, 43.3, i.e. at a setpoint value input of the speed control device 14, a permanently programmed speed setpoint value or a permanently programmed delay set value is applied. At the same time, the timer 44 is started with an adjustable waiting time. If, after an expired waiting time the excess speed signal is still applied, the reaction generator 40.1 activates the next braking measure and restarts the timer 44. If also after the expiration of the second waiting time the speed limit value is still being exceeded, a last braking measure or the safety catch is activated.

According to an embodiment of the method disclosed in the invention, the speed limit values 28 supplied to the comparator 39 by the limit value module 38 do not always correspond to position-depended speed limit values, permanently stored in the tables of the limit value module but instead, the stored speed limit values are continuously adapted in the areas in which the elevator control 15 specifies a reduced speed set value to the reduced set values by a processor integrated in a limit value module 38. This occurs, in particular, when stopping at a floor. The limit value module obtains the information required from the elevator control 15 for this purpose via a data line 45.

The method of the invention can naturally also be applied to elevator systems with more than three different braking measures.

The travel way/speed diagram in FIGS. 7 and 8 shows details of the method disclosed by the invention with several different speed limit value graphs 28, each of which, are assigned to different braking measures. In FIG. 7 the diagram also contains graph 27 for comparison that represents a normal elevator speed. The diagram also shows three speed limit value graphs 28. An assumed actual speed 29 exceeds the first speed limit value graph 28.1 at point 46 upon exceeding the nominal speed or leaving a travel way end zone or a floor stopping zone. The speed monitoring device 24.2 detects this and activates a first brake measure, i.e. in the present example, it attempts to cause the speed control device 14 to reduce the drive speed with a predefined delay according to control brake graph 33. Also in this case, the first braking measure does not necessarily cause the elevator to stop. Provided the second speed limit value graph 28.2 is not exceeded and the system device integrated in the elevator control 15 does not signal a relevant error, the elevator can continue its travel as planned. If, however, the first braking measure is not or insufficiently effective, so that also a second speed limit value graph 28.2 is exceeded, the speed control device 24.2 activates a second braking measure at point 47 on the graph (the mechanical drive brake 10 on the drive motor 9 in FIG. 1A or the clasp brake acting on the piston rod 52 in FIG. 1B), as a result of which the elevator is to be brought to a standstill in accordance with drive brake graph 34. If this brake measure does not or does not sufficiently reduce the speed, the speed monitoring device 24.2 triggers the, according to this embodiment, last braking measure at point 48, i.e. it activates the electromagnetically activatable safety catch 18, stopping the elevator according to safety brake graph 35.

The travel way/speed diagram in FIG. 8 shows how, in the method of the invention, braking measures are triggered by several speed limit value graphs 28.1, 28.2 and 28.3 if an assumed actual speed 29 of the elevator exceeds one or several of the falling speed limit value graphs 28.1, 28.2, 28.3 in a travel way end zone or a floor stopping zone without exceeding the nominal speed as, for instance, the required reduction of the actual speed does not occur. After the first braking measure was triggered at point 46 of the graph by the speed monitoring device 24.2, the same processes as described for FIG. 7, take place.

FIG. 9 is a diagrammatic view of the electronic speed monitoring device 24.2 disclosed in the invention, as used for the method with several speed limit value graphs 28.1, 28.2, 28.3 as described for FIGS. 7 and 8. The device comprises mainly the same modules as the speed monitoring device 24.1 described for FIG. 6 with, however, one limit value module and one comparators being provided for each speed limit value graph 28.1, 28.2, 28.3. It thus contains three limit value modules 38.1, 38.2, 38.3 and three comparator 39.1, 39.2, 39.3 as well as a mutual reaction generator 40.2. On one hand, the speed monitoring device 24.2 continuously receives information about the actual position of the elevator car 8 in the elevator shaft 1, generated by the position detection device 21, via the position data input 41. On the other hand, it continuously receives information about the actual speed of the elevator from the elevator controls via its actual speed input 42. In each of the three limit value modules 38.1, 38.2, 38.3, position-dependant speed limit values are stored in each table with the values contained in each case in a table resulting in three speed limit value graphs 28.1, 28.2, 28.3, described in FIGS. 7 and 8, i.e. to each of the tables one of the three different braking measures is assigned and each table contains a speed limit value for each position of the elevator inside the shaft, assigned to the braking measure.

During the operation of the elevator, the respective speed limit values for the three different brake measures corresponding to the actual shaft position of the elevator cab 8 are continuously read off from each of the tables stored in the limit value modules 38.1, 38.2, 38.3 and are compared with the current actual speed in the comparators 39.1, 39.2, 39.3 allocated in each case to one of the limit value modules 38.1, 38.2, 38.3. As soon and as long as one of the comparators 39.1, 39.2, 39.3 detects that the current actual speed exceeds the position-dependent defined current speed limit value, stored in the respective table, it sends a respective excess speed signal to the reaction generator 40.2. The generator immediately activates one of the three possible braking measures allocated to the signal-providing comparator and the respective limit value module.

According to one embodiment of the method of the invention described in connection with FIG. 9 with several different speed limit value graphs 28.1, 28.2, 28.3, the speed limit values supplied to the comparator 39.1, 39.2, 39.3 by the three limit value modules 38.1, 38.2, 38.3 do not always correspond to the position-dependant speed limit values permanently stored in the tables of the limit value module but instead, the stored speed limit values are continuously adapted to these reduced set values in the travel way areas in which the elevator control 15 specifies a reduced speed set value, by a processor integrated in the limit value module 38.1, 38.2, 38.3. This occurs, in particular, when stopping at a floor. The limit value modules 38.1, 38.2, 38.3 obtain the information required from the elevator control 15 for this purpose via a data line 45.

Naturally, the entire method described with reference to FIG. 9 can also be applied for elevators with more than three different braking measures.

A speed monitoring method, fulfilling particularly stringent safety requirements, can be implemented by combining the method containing a time-dependant reaction control according to FIGS. 4, 5, 6 with the method with several different speed limit value graphs 28 according to FIGS. 7, 8, 9 with always another braking measure being triggered if the preceding braking measure has not lead to a defined speed reduction within a defined time or if a position-dependant speed limit value, assigned to this further braking measure, is exceeded.

In order to ensure that method of the invention meets the high safety requirements of an elevator system, at least all functions involved in the activation of the safety catch have to be fail safe. Suitable measures for implementing such fail-safe concepts are known to experts and include, for instance:

Redundancy for position and speed detection devices, data processing processors, actuators for the activation of braking equipment, etc.

Data backup methods during data transmission

Parallel data processing by several, possibly different processors including comparison of the result and activation of suitable backup measures in case of occurring errors.

In order to guarantee a safe operation even in case of a power failure or in case of a failure of the power supply of the controls, the circuits important for the method of the invention are supplied by suitable standby units, such as batteries or capacitors.

The invention claimed is:

1. A method for preventing an inadmissibly high speed of a load receiving means of an elevator, comprising the steps of:

supplying information about an actual position and an actual speed of the load receiving means in an area of an entire travel way of the load receiving means to a speed monitoring device by at least one measuring system;

continuously comparing the actual speed with a speed limit value by the speed monitoring device; and activating braking measures if the speed of the load receiving means exceeds a speed limit value, at least three different braking measures being successively triggered by the speed monitoring device.

2. A method according to claim 1, including activating one of the braking measures when a speed limit value assigned to this braking measure is exceeded.

3. A method according to claim 1, including activating, in each case, a further braking measure if a preceding braking measure has not produced a defined speed reduction within a certain time period.

4. A method according to claim 1, including, in each case, activating a further braking measure if a speed limit value allocated to the braking measure is exceeded or if a preceding braking measure has not produced a defined speed reduction within a certain time period.

5. A method according to claim 1, wherein the elevator comprises a drive unit for the load receiving means including a speed control device, the step of activating a braking measure including an attempt by the speed monitoring device to influence the speed control device of the drive unit so that the speed control device reduces the drive speed of the load receiving means.

6. A method according to claim 5, including achieving a reduction of the drive speed of the load receiving means by applying a permanently stored set speed value or a permanently stored set delay value to a set value input of the speed control device.

7. A method according to claim 1, wherein the elevator is a cable-pulled elevator with a drive machine, a driving wheel, and a pulling cable, the step of activating a braking measure including activating a friction brake, acting directly or indirectly on the driving wheel, by the speed monitoring device.

8. A method according to claim 1, wherein the load receiving means is guided along guide rails, the method including a further braking measure that consists of activating friction brakes acting between the load receiving means and the guide rails by the speed monitoring device.

9. A method according to claim 1, wherein the elevator is hydraulically operated, one of the braking measures includes increasingly restricting a flow of a hydraulic medium determining movement of a hydraulic lifter by the speed monitoring device through a flow valve or of a friction brake acting on a piston rod of the hydraulic lifter that is activated by the speed monitoring device.

10. A method according to claim 1, wherein one of the braking measures includes activating at least one safety catch with the speed monitoring device, the safety catch being mounted on the load receiving means and acting on rails permanently installed along the travel way and stopping the load receiving means.

11. A method according to claim 1, wherein the speed limit values assigned to the braking measures with which the actual speed is continuously compared by the speed monitoring device depend on the actual position of the load receiving means and contain a required speed reduction in both end zones of the travel way.

12. A method according to claim 1, wherein the speed limit values assigned to the braking measures with which the actual speed is continuously compared by the speed monitoring device are permanently defined and stored for each position of the load receiving means.

13. a method according to claim 1, wherein the speed limit values assigned to the braking measures with which the actual speed is continuously compared by the speed monitoring device are continuously calculated by a micro processor according to the actual position of the load receiving means, taking into consideration permanently programmed speed limit values as well as information from elevator controls about a planned travel operation.

14. A method according to claim 1, wherein after a successful braking measure triggered by an excessive speed, the elevator automatically returns to normal operation or enters an evacuation operation as long as a type of a last braking measure and a result of an automatically carried out functional test of the safety-relevant components allow this.

15. A method according to claim 1, including using a comprehensive fail safe concept for the determination of the position and the speed of the load receiving means, the comparison of the speed with the speed limit values as well as for the activation of the braking measures.

* * * * *